United States Patent [19]

Alexander, Jr.

[11] Patent Number: 4,615,929

[45] Date of Patent: Oct. 7, 1986

[54] COMPUTER PAPER

[76] Inventor: George Alexander, Jr., 2910 McKinney, Houston, Tex. 77002

[21] Appl. No.: 792,798

[22] Filed: Oct. 30, 1985

[51] Int. Cl.[4] ..... B42D 19/00

[52] U.S. Cl. ..... 428/43; 428/131; 281/2; 281/5; 283/62; 283/105

[58] Field of Search ..... 281/2, 5; 283/62, 105; 428/43, 131

[56] References Cited

U.S. PATENT DOCUMENTS

| | | | |
|---|---|---|---|
| 3,658,364 | 4/1972 | DaMert | 281/5 |
| 4,465,729 | 8/1984 | Cancio et al. | 428/167 |
| 4,508,365 | 4/1985 | Hawes | 428/43 |
| 4,551,374 | 11/1985 | Holmberg | 428/43 |

*Primary Examiner*—John E. Kittle
*Assistant Examiner*—Patrick J. Ryan
*Attorney, Agent, or Firm*—David M. Ostfeld

[57] ABSTRACT

An arrangement of lines of perforation on computer paper is disclosed. Horizontal lines of fine perforations are placed at intervals of 2.75 inches throughout the entire length of a single length of computer paper, and three vertical lines of fine perforations run the entire length of the paper, one each at a one-half inch distance from each edge of the paper, and the third line at 9.00 inches from the left edge of the paper. By virtue of such arrangement, a single length of computer paper can produce at least three standard sizes of page rather than only one size as in the prior art, obviating the need to change the paper each time that a different size page is desired. Also, there is a substantial reduction in the amount of each length of computer paper that is wasted when a sheet is torn from the printer and printing is commenced on the next available sheet. The method of perforation and the number of perforations per inch on each line of perforations is such that paper strength and quality of printing is maintained and the perforations are invisible on photostatic reproductions.

15 Claims, 2 Drawing Figures

COMPUTER PAPER

TECHNICAL FIELD

The invention relates generally to computer paper. More specifically, it relates to improved layout and designs of perforations on computer paper.

BACKGROUND ART

For many years the paper used in computer printer machines ("printers") has been manufactured in long lengths to allow continuous feed to the printer. Each length has horizontal lines of perforations at 11 inch intervals to allow paper that has been run through the printer to be torn and removed from the printer. The horizontal perforations also allow the paper to be folded into cartons which hold the paper until fed into the printer. In present practice, each length of paper between adjacent horizontal lines of perforation counts as one sheet, and one carton of paper usually contains between 750 and 3500 sheets. The paper also has a vertical line of perforation running along each edge of the paper, usually at a one-half inch distance from each edge, to allow the removal of the one-half inch margins which contain feeder holes. The feeder holes, which usually number two per inch, serve only the purpose of allowing the paper to be pulled through the printer by feeder pins on tractor wheels. These feeder holes are not considered to be lines of perforation for purposes of this application.

In the prior art, only one size of sheet can be produced from any one length or carton of computer paper. Three of the most common sizes of sheet are: (1) $9\frac{1}{2}\times 11$ inches, (2) $9\frac{1}{2}\times 14$ and (3) $14\frac{7}{8}\times 11$ inches. Upon removal of the feeder hole margins, each of the above sheet sizes produces, respectively: (1) an $8\frac{1}{2}\times 11$ inch letter size page, (2) an $8\frac{1}{2}\times 14$ inch legal size page, and (3) a $13\frac{7}{8}\times 11$ inch spreadsheet page. However, no one length or carton of paper can produce all three sizes of sheets or pages. Consequently, any change in the page size requires that the paper currently in the printer be physically detached and that the paper producing the desired page size be physically inserted into the printer.

Also in the prior art, the tractor wheels on the printer is often positioned approximately 2.75 inches above the tear bar. In order to remove a sheet from the printer, the bottom line of perforation of the printed sheet must be positioned above the tractor wheel. As a consequence, the top edge of the next sheet (the "first blank sheet") is 2.75 inches beyond the tear bar and thus beyond the line on which printing would begin on the first blank sheet. Since the operator generally prefers that printing begin at the top of a sheet rather than 2.75 inches down from the top, he must advance the paper until the bottom of the first blank sheet is just above the tear bar and the printhead is at the top of the following blank sheet. The first blank sheet is torn off when the bottom of that sheet has advanced to the tractor wheels. This results in the wastage of the entire length of the first blank sheet, or 11 to 14 inches of paper.

DISCLOSURE OF THE INVENTION

Lines of perforation on computer paper so that a single length or carton of paper can produce all three of $8\frac{1}{2}\times 11$ inch, $8\frac{1}{2}\times 13\frac{3}{4}$ inch, and $13\frac{7}{8}\times 11$ inch size pages, and so that it is not necessary to advance the entire first blank sheet to begin printing, is disclosed. In addition, the design of perforations is modified to maintain paper tensile strength while allowing the paper to be easily torn, and so that lines of perforation do not show on photostatic copies and print quality is maintained.

BRIEF DESCRIPTION OF THE DRAWINGS

For a further understanding of the nature and objects of the present invention, reference is made to the following drawings in which like parts are given like reference numerals and wherein.

PREFERRED MODE FOR CARRYING OUT THE INVENTION

Figure 1:
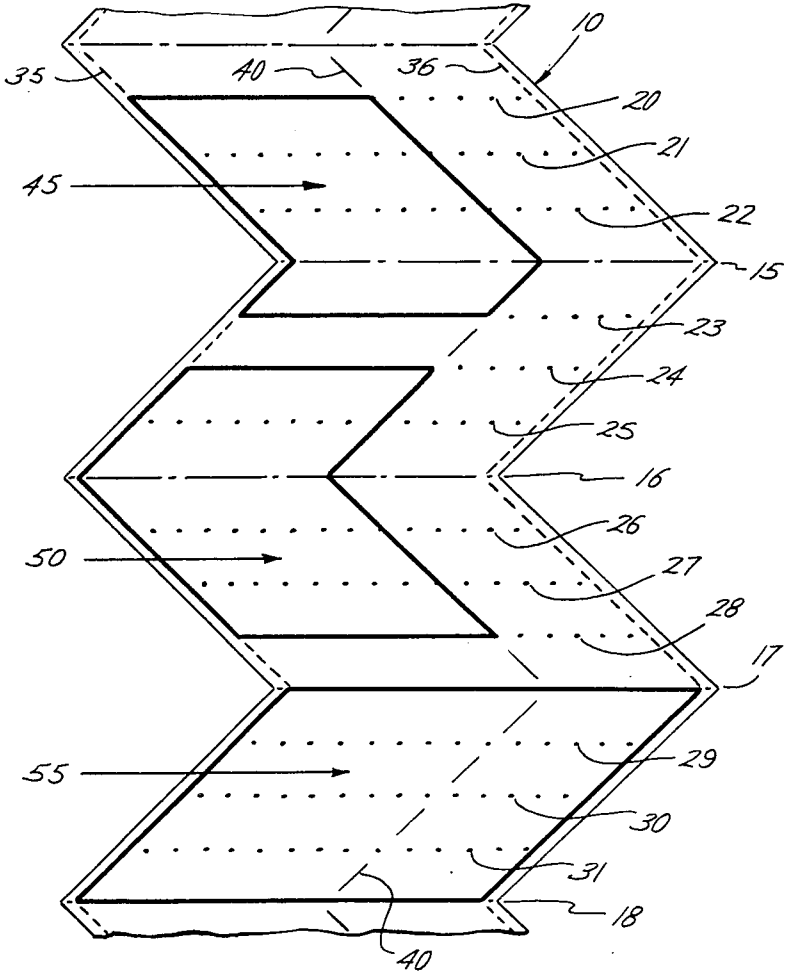

In FIG. 1, there is shown a length of computer paper 10 fan-folded along horizontal lines of perforations 15, 16, 17, 18 at eleven inch intervals. At intervals of 2.75 inches along the entire length of the paper are horizontal lines of perforations. Within each sheet created by the paper fold lines 15–18, there are three additional lines of perforation 20-21-22, 23-24-25, 26-27-28, 29-30-31. Except for the paper fold lines 15–18, perforations in each of the horizontal lines of perforations 20–31 range in number from eight to twelve slots per inch, depending on paper tensile strength, and are cut with the slicing method for clean edges. The paper fold lines 15–18 comprise 5 slots per inch cut with the punching method, resulting in a more durable perforation at the fold lines 15–18.

Three vertical lines of perforations which run the entire length of the paper are also shown in FIG. 1. Located one-half inch from each edge of the paper are lines 35, 36 which permit the removal of the one-half inch margins containing the feeder holes (not shown). These margin lines 35 and 36 comprises 8 slots per inch with 8/1000 inch paper connections providing strength for the paper feeding action. A third vertical line of perforation 40 runs 9.00 inches from the left-hand edge of the paper and has perforations ranging in number from 8 to 72 slots per inch, depending on paper tensile strength, cut with the slicing method.

Illustrated in FIG. 1 are the three different sizes of pages that can be obtained from a single length of paper 10, obviating the need to change paper each time that a different size page is desired. Page 45 is a letter size page measuring $8\frac{1}{2}$ by 11 inches, created by tearing the paper 10 horizontally at lines 20, 23 and vertically along lines 35, 40. Page 50 is a legal size page measuring $8\frac{2}{3}$ by $13\frac{3}{4}$ inches, created by tearing the paper 10 horizontally at lines 24, 28 and vertically at lines 35, 40. Finally, page 55 is a spreadout size page measuring $13\frac{7}{8}$ by 11 inches, created by tearing the paper horizontally at lines 17, 18 and vertically at lines 35, 36.

Figure 2:
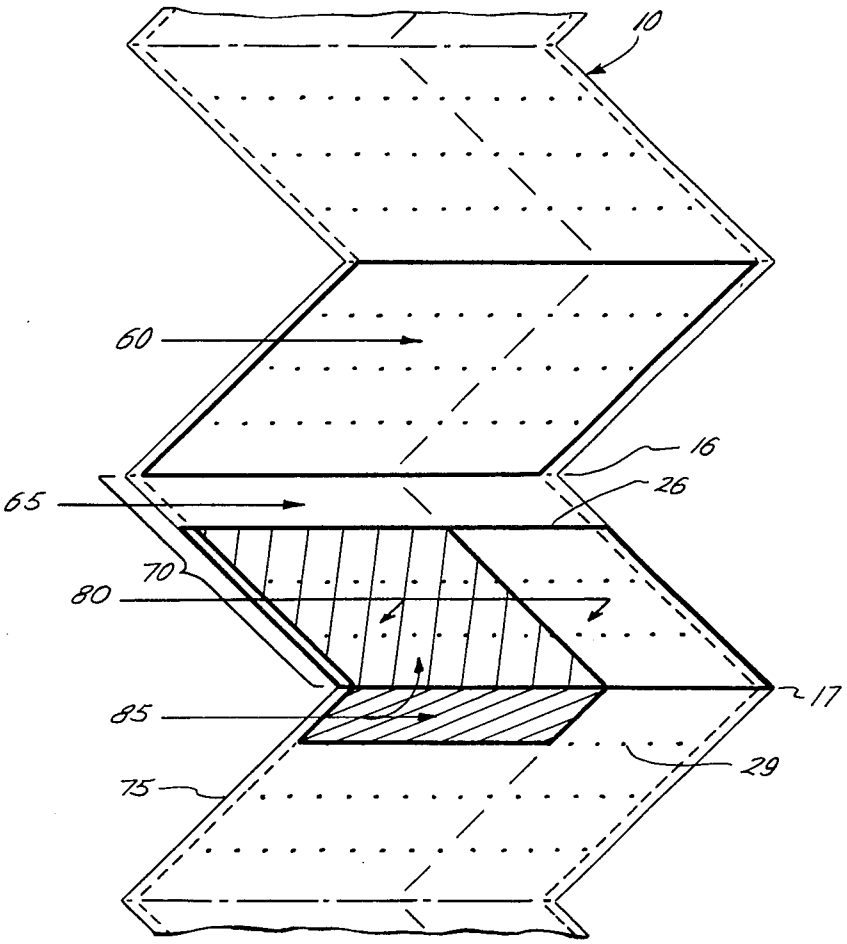
FIG. 1 and FIG. 2 depict the preferred embodiment of the present invention as a perspective of a length of computer paper $14\frac{7}{8}$ inches in width and folded in alternate directions ("fan-folded") along a horizontal line of perforations at every 11 inches of length, thereby creating four connected full sheets $14\frac{7}{8}$ inches wide and 11 inches long bearing shadings for illustration of description. There are other lines of perforation within each sheet.

FIG. 2 is the same drawing as FIG. 1 and accordingly uses some of the same reference numerals, except that instead of illustrating the three sizes of pages 45, 50, 55 that can be produced from the invention, FIG. 2 illustrates the means by which the invention substantially reduces paper wastage. Sheet 60 represents the last sheet on which printing appears and that the printer operator wishes to remove from the machine. Space 64, existing between horizontal lines 16 and 26 on the next sheet (the first blank sheet) 70, represents the length of paper between the tractor wheels at line 16 and the tear bar and printhead at line 26. If the paper 20 is torn at line 16, which it must be to allow the removal of sheet 60, there can be no printing on space 65 since that length of paper has already passed the printhead. Space 65 thus represents wasted paper. In addition, in the prior art, if the printer operator wished to begin printing at the top of the next available sheet, the first blank sheet 70 would have to be pulled through the printer until the bottom of the first blank sheet 70 and the top of the next blank sheet 75 was at the tear bar and printhead (now at line 17). Printing would begin at the top of sheet 75 and nothing would be printed on the entire length of the first blank sheet 70. This resulted in additional wastage of paper 80.

The present invention prevents the wastage of space 80. Assuming again that the bottom of the last printed sheet 60 is at the tractor wheels at line 16 and the tear bar and printhead is at or just below line 26, printing can begin at line 26 and continue until line 26 on sheet 70 has advanced as far as the tractor wheels. At that point space 65 can be torn off, and the top of the page being printed would be at line 26 rather than line 16. The bottom of an eleven inch page 85 beginning at line 26 would be moved from line 17 to line 29. As illustrated, only the space 65 between lines 16 and 26 would be wasted. The space 80 between lines 26 and 17 would be wasted under the prior art but would be used under the present invention.

It is anticipated that computer paper incorporating the present invention will be 12 to 24 pound basis weight, registered bond 100% pulp paper. This weight and type of paper is sufficient to accommodate the perforations comprising the present invention while also providing a high quality finish, high tensile strength, freedom from lint, high brightness, and high dimensional stability. However, the present invention may also be used with other weights and types of paper, and so the above description of paper should not be construed as limiting. Similarly, the number of perforations per line or inch of perforation and the method of perforation as described in this application should not be construed as limiting.

Because many varying and different embodiments, as illustrated above, may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A sheet of computer paper, comprising:

a sheet of paper, said sheet including at least one horizontal line of perforations;

said sheet including three vertical lines of perforations, the middle vertical line of said vertical lines of perforations being eight to nine and one-half inches from the left-hand said edge of said sheet of paper, as measured by facing said sheet of paper.

2. The sheet of claim 1, wherein there are three of said horizontal lines of perforations.

3. The sheet of claim 2, wherein each of said horizontal lines of perforations include eight to twelve slots per inch.

4. The sheet of claim 3, wherein each of said horizontal lines of perforations is cut by a slicing method.

5. The sheet of claim 2, wherein each of said horizontal lines of perforations is cut by the slicing method.

6. The sheet of claim 2, wherein said horizontal lines are spaced substantially at 2.75 inch intervals along said sheet of paper.

7. The sheet of claim 2, wherein said middle vertical line of perforations includes eight to seventy-two slots per inch.

8. The sheet of claim 7, wherein said middle vertical line of perforations is cut by the slicing method.

9. The sheet of claim 2, said two outside vertical lines of perforations being substantially one-half inch from each edge of said sheet.

10. The sheet of claim 2, wherein said sheet of paper has twelve to twenty-four pound basis weight.

11. The sheet of claim 10, wherein said sheet of paper is of registered bond.

12. The sheet of claim 11, wherein said sheet of paper has 100% pulp.

13. The sheet of claim 1, wherein said middle vertical line of perforations includes eight to seventy-two slots per inch cut by the slicing method.

14. A set of computer paper, comprising:

at least two sheets of paper, said sheets being fan-folded along horizontal lines of perforations;

each of said sheets of paper including three substantially evenly spaced horizontal lines of perforations, a vertical line of perforations, said vertical line of perforations being eight to nine and one-half inches from the left-hand edge of said sheet of paper, as measured by facing said sheet of paper.

15. A set of computer paper, comprising:

at least two sheets of paper, said sheets being fan-folded along horizontal lines of perforations;

each of said sheets of paper having twelve to twenty-four pound basis weight, registered bond, 100% pulp;

each of said sheets of paper including three substantially evenly spaced horizontal lines of perforations;

each of said horizontal lines of perforations include eight to twelve slots per inch cut by the slicing method, spaced substantially at 2.75 inch intervals along each of said sheets of paper;

each of said sheets of paper including three vertical lines of perforations;

said first vertical line of perforations includes eight to seventy-two slots per inch cut by the slicing method;

said second and third vertical lines of perforations being substantially one-half inch from each edge of each of said sheets and said first vertical line of perforations being substantially nine inches from said left-hand edge of each of said sheets of paper.

* * * * *